United States Patent [19]

Starks

[11] 4,208,841

[45] Jun. 24, 1980

[54] STOP ASSEMBLY AND SYSTEM FOR SLIDING CLOSURES

[75] Inventor: Emmett A. Starks, Rocky River, Ohio

[73] Assignee: Better-Way Products Company, Westlake, Ohio

[21] Appl. No.: 949,743

[22] Filed: Oct. 10, 1978

[51] Int. Cl.[2] ..... E05D 13/04

[52] U.S. Cl. ..... 49/449; 292/343; 24/204

[58] Field of Search ..... 46/449; 292/342, 343; 248/205; 24/204

[56] References Cited

U.S. PATENT DOCUMENTS

| | | | |
|---|---|---|---|
| 1,695,872 | 12/1928 | White, Jr. | 292/343 |
| 2,472,216 | 6/1949 | Kasik | 292/343 |
| 3,387,341 | 6/1968 | Mates et al. | 248/205 R |
| 3,448,542 | 6/1969 | Walters | 49/449 |
| 3,754,783 | 8/1973 | Childers | 49/449 X |
| 3,861,703 | 1/1975 | Gould | 24/204 X |
| 3,977,714 | 8/1976 | Trotter | 292/343 |

*Primary Examiner*—Kenneth Downey
*Attorney, Agent, or Firm*—Maky, Renner, Otto & Boisselle

[57] ABSTRACT

A stop assembly for a sliding closure includes a wedge-shape stop member which may be removably secured to the closure in a position where the stop member will become wedged between the relatively sliding members to preclude opening more than a predetermined distance. Cooperating pad-like elements having respectively numerous hooks and loops thereon are affixed to the closure and stop member, respectively, and when in mating engagement resist separation in a direction parallel to the direction of movement of the sliding member to preclude opening of the closure and are readily separable in a direction normal to such direction of movement to remove the stop member to permit unobstructed opening of the closure. When not in use, the stop member may be independently secured in a convenient storage location where it will not interfere with such closure movement by another pad-like element cooperating with the element affixed to the stop member.

13 Claims, 5 Drawing Figures

STOP ASSEMBLY AND SYSTEM FOR SLIDING CLOSURES

BACKGROUND OF THE INVENTION

The present invention relates to stop assemblies and security systems for closures and in particular to stop assemblies for sliding doors and windows to prevent unauthorized opening of the same.

Sliding doors and windows even when latched are known to provide relatively easy unauthorized access to homes and other building structures. Such doors and windows may be forced in their tracks from a closed position to an open position by a crowbar or other means forcibly overcoming the relatively small retaining force normally afforded by many latch assemblies currently in use.

To prevent the sliding doors and windows from being forced open, additional secondary security devices have been used. One such device simply consists of an elongate bar or stick which is positioned within the space between the frame of the sliding door or window panel and the opposing jamb. When it is desired to open the sliding panel, the stick is removed from the sliding door or window assembly and placed in a storage area until needed again. However, the stick is frequently misplaced or gets carried away and then is not readily available for use when it is desired again to secure the door or window. In addition, the rods and bars are unsightly and awkward to handle. Moreover, often no provision can be made for permitting only partial opening of the sliding closure for ventilation purposes.

Various latches have also been employed. However, such latches normally require the need to drill holes in the door panels and frames to install the same. Also, manipulation of the latches is often clumsy, and more often than not such latches do not provide any better security than the latch assembly originally provided.

Still another type of stop device for double sash windows is a wedge-shape stop which limits the movement of the lower sash. The stop member includes a prong for attachment purposes which engages the upper sash and a resilient pad which frictionally engages the surface of the upper sash when engaged by the lower sash thereby to prevent opening of the lower sash beyond a predetermined amount.

SUMMARY OF THE INVENTION

In accordance with the present invention, unauthorized opening of a sliding closure is precluded by a stop assembly including a stop member which may be releasably secured in a position to engage a sliding member of the closure and thereby prevent further opening of the sliding closure. Cooperating hook and loop elements affixed to the stop member and closure resist separation in a direction parallel to the direction of movement of the sliding member to preclude movement of the sliding member in such direction, and are readily separable in a direction normal to such direction of movement for easy removal of the stop member to allow normal usage of the sliding closure.

The stop member is preferably wedge-shape to prevent the development of peeling forces and to ensure positive securement of the stop member when engaged by the slidng panel. The stop member further is of a low profile and may be conveniently stored when not in use by another hook or loop element cooperating with that affixed to the stop member. The hook and loop elements may comprise pad-like members that may be readily affixed to the stop member and closure by high shear, high peel adhesive.

It is accordingly a principal object of this invention to provide a secondary security device for sliding closures which is easy to install and use, attractive in appearance, and does not interrupt the view through glass panels when used therewith.

Another object is to provide such a stop assembly which is convenient to use and may also be conveniently stored when not in use.

Yet another object is to provide such a stop assembly that does not require holes to be drilled or screws to be used for installation.

Still another object is to provide such a stop assembly that is child-proof.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIG. 1 is a perspective view of a preferred form of stop assembly in accordance with the present invention shown ready for installation on a sliding glass door assembly and the like;

DESCRIPTION OF THE PREFERRED EMBODIMENT

Figure 1:
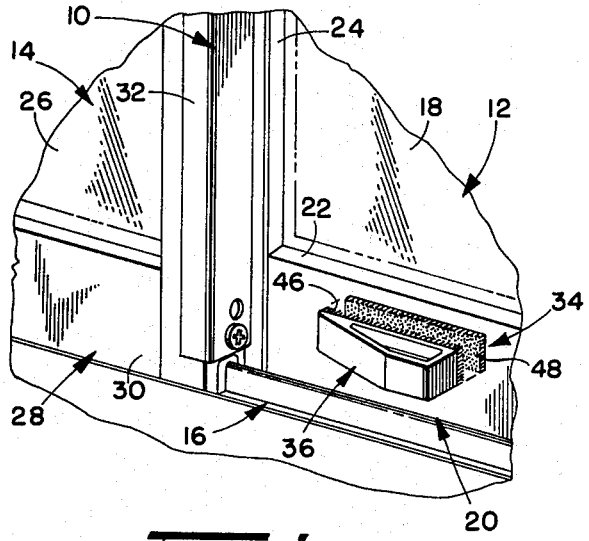

Referring now in detail to the drawing, FIG. 1 shows a portion of a sliding glass door assembly generally designated by reference numeral 10 as viewed from the interior of a space which is to be secured. The sliding glass door assembly 10 may be of conventional type including a pair of door panels generally indicated by reference numerals 12 and 14 which are supported in a frame 16, only the base track of which is shown. The stationary door panel 12 includes a glass panel 18 enclosed within a rectangular frame 20 comprised of horizontal and vertical frame members 22 and 24, respectively, which are commonly rigidly secured to the frame 16. Sliding door panel 14 includes a glass panel 26 enclosed within a rectangular frame 28 which is slidably mounted in the frame 16 for movement in a horizontal plane inwardly of the stationary door panel 12. Similar to stationary panel frame 20, the sliding panel frame 28 includes horizontal and vertical frame members 30 and 32, respectively.

In conventional manner, the sliding door panel 14 is movable between an open position of substantial overlap with the stationary door panel 12 and a closed position with only the vertical frame members 24 and 32 of the respective frames 20 and 28 overlapping as seen in FIG. 1. When closed, the sliding door panel may be secured to the frame 16 by a suitable latch assembly (not shown). As previously noted, most such latch assemblies have the objection that they are subject to being forced open with a pry bar to gain entrance to a home or other building structure. In accordance with the present invention, authorized opening of the sliding door panel 14 may be prevented by employing the stop assembly designated generally by the reference numeral 34. Such stop assembly includes a stop member or obstruction 36 which, when in use, may quickly and easily be attached to the horizontal frame member 22 of the stationary door panel 20 in close proximity to the sliding door panel 14 to preclude or limit opening of the latter, and just as easily removed to permit unobstructed opening of the sliding door, in a manner to be subsequently described.

Figure 4:
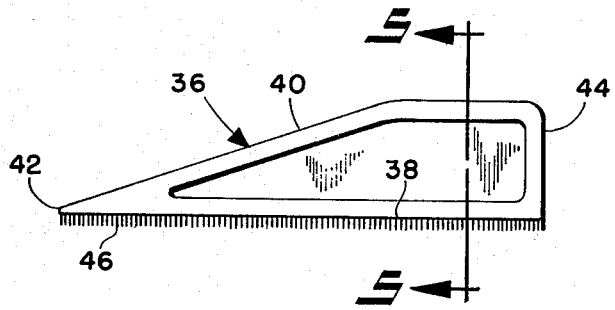
FIG. 4 is an enlarged side elevation view of such stop member.
Figure 5:
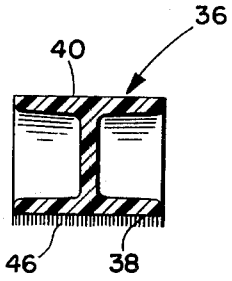
FIG. 5 is a vertical transverse section through the stop member of FIG. 4, taken on the plane of the line 5—5 thereof.

As perhaps best seen in FIGS. 4 and 5, the stop member 36 is of generally wedge-shape having a flat base surface 38 and a top surface 40 which inclines from a nose 42 to a butt 44. The stop member 36 is preferably made of a suitable plastic having the required compressive strength such as ABS plastic, it of course being understood that such stop member may also be made of other materials. To enhance its strength while minimizing the amount of material required, the stop member 36 desirably has an I-beam construction as shown in FIG. 5, with the web of the "I" extending substantially normal to the base surface 38. Accordingly, the flanges of the "I" form the top and bottom surfaces 40 and 48, respectively.

Referring further to FIG. 1, the stop member 36 is removably secured to the stationary door panel frame 20, for preventing unauthorized opening of the sliding door panel 14, by a pair of pad-like elements 46 and 48 which may be relatively permanently affixed respectively to the base surface 38 of the stop member and to the horizontal frame member 22 of the stationary panel 12 as by providing such pad-like elements with adhesive backings. Preferably, high-shear, high-peel adhesives are used. Pad-like element 46 affixed to the base surface 30 of the stop member has numerous small loops of nylon or other strand-like material on the exposed side thereof, and pad-like element 48 affixed to the stationary panel 12 has numerous small hook-like strands extending from its exposed surface for engaging the loops of pad-like element 46 when brought into contact therewith,or vice versa, as by pressing the pad-like elements 46 and 48 into engagement with one another for securing the same together and thus the stop member 36 to the stationary panel 12. The type of material used for the pad-like elements 46 and 48, for example, is sold under the trademark VELCRO brand hook and loop fasteners by Velcro Corporation.

It will be appreciated that because of the properties of the mating hooks and loops which permit their attachment by merely placing the surface defined by the hooks into face-to-face relationship with the surface defined by the loops so that a large number of hooks engage a large number of loops, such attachment resists separation parallel to the interfacial plane of engagement but is readily separable by peeling forces applied substantially normal to such interfacial plane. Accordingly, substantial force is required to move the stop member 36 in a direction parallel to the door, but the stop member may be easily removed by peeling the same from the pad-like element 48.

Figure 2:
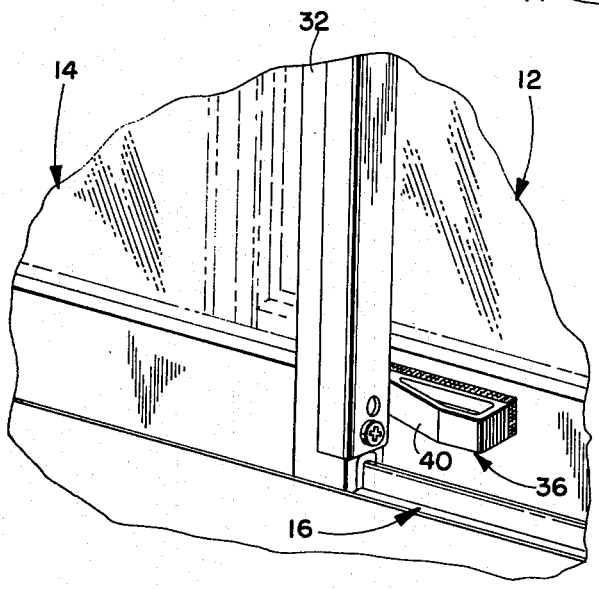
FIG. 2 is a perspective view similar to FIG. 1 but showing the stop assembly in position limiting the amount of opening movement of the sliding door panel relative to the stationary door panel.
Figure 3:
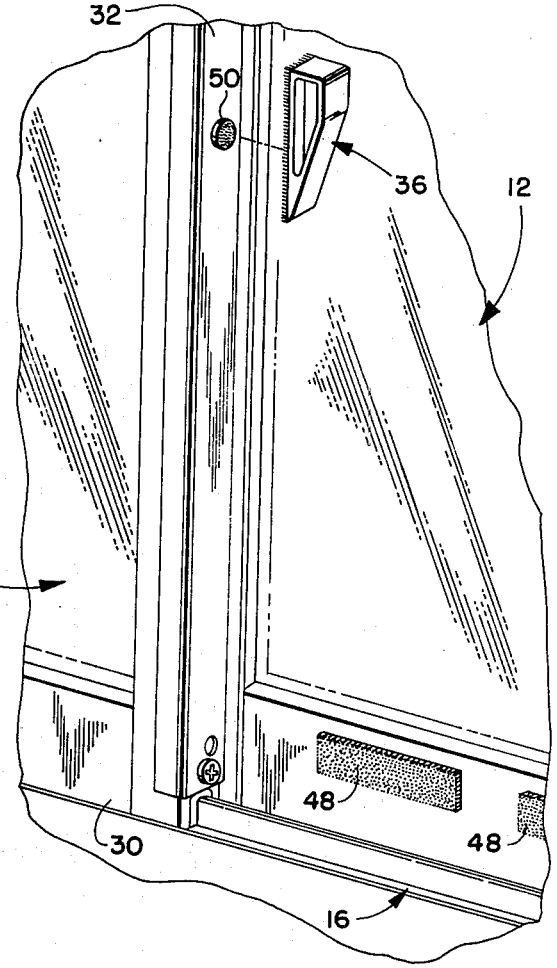
FIG. 3 is a perspective view showing the wedge-shape stop member of the assembly removed from its normal stop position ready to be stored in a convenient storage location on the vertical frame member of the sliding panel where it will not interfere with its sliding movement.

Referring now to FIGS. 1 through 3, the use and operation of the stop assembly will be described. The pad-like element 48 is shown affixed to the stationary door panel on its horizontal frame member 22 as described above in a position in close proximity to the vertical frame member 32 of the sliding door panel 14 when the same is closed. In the illustrated embodiment, the pad-like element 48 is positioned to permit partial opening of the sliding door panel 14 as for purposes of ventilation when the stop member 36 is in place. To prevent the sliding door panel from being opened any further, the stop member 36 is secured to the stationary panel 12 by positioning the stop member 36 with the pad-like member 46 affixed thereto against pad-like element 48 with the inclined surface 40 of the stop member generally facing in the direction of the sliding door panel 14. In the event an attempt is made to open the door further, the door will engage the inclined surface 40 of the stop member as best seen in FIG. 2, which acts as a wedge, preventing further movement in the opening direction. The greater the opening force, the more the pressure exerted on the stop member to hold the stop member in place and maintain such engagement of the pad-like elements. The wedge-shape of the stop member also ensures that no peeling force will develop when engaged.

It will be appreciated that the pad-like element 48 may be secured to the stationary panel 12 at any suitable location to provide for partial opening of the door for ventilation purposes as desired, and may also be placed at the top of the door frame out of reach of little children to prevent them from opening the door by removing the stop member from the inside as well. Also, several pads, or a long pad, may be provided on the stationary panel to permit adjustment of the extent of permitting opening, the stop member being secured at the desired location on the elongate pad or one of several such spaced apart pads as shown in FIG. 3.

To permit complete or normal opening of the door, the stop member 36 is simply removed by peeling the stop member with the pad-like element 46 affixed thereto from the pad-like element 48 while leaving the latter in place since it will not interfere with normal usage of the door. When not in use, the stop member may be conveniently stored in easy reach for later use as by providing another pad-like element 50 of the same type as pad-like element 48, but preferably much smaller, and located at a convenient, but noninterfering location, such as on the vertical frame member 32 of sliding panel 14 as further shown in FIG. 3, so that the stop member with pad-like element 46 may be pressed thereagainst to secure the same.

Although the stop assembly 34 has been shown and described as being located on a stationary door panel 12, it should be understood that such door panel 12 need not be stationary as described but instead may be a sliding panel. In such case, the stop assembly will preclude unauthorized opening of either sliding door panel. Also, the stop assembly is equally applicable for use in preventing unauthorized opening of sliding glass windows and other structures.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows:

1. A stop assembly for employment with sliding closures including relatively sliding members that move relative to one another in spaced-apart parallel planes, said stop assembly comprising a generally wedge-shaped stop member, separable hook and loop means, and means for affixing one of said hook and loop means to said stop member and the other of said hook and loop means to such one of the relatively sliding members, said hook and loop means being adapted for mating engagement detachably to secure said stop member to one of the relatively sliding members at a location for abutment with the other of the relatively sliding members to restrict relative sliding movement of the relatively sliding members, said hook and loop means when engaged being resistant to separation in a direction parallel to such parallel planes and being readily separable in a direction normal to such parallel planes.

2. The stop assembly of claim 1 wherein said means for affixing comprises a high-shear, high-peel adhesive.

3. The stop assembly of claim 1 further comprising an additional said other of said hook and loop means for storage of said stop member when not in use, and means for affixing said additional said other hook and loop means in close proximity to the sliding closure at a location such as not to interfere with normal operation of the sliding closure when said stop member is stored thereon.

4. The stop assembly of claim 1 wherein said stop member has a base surface and an inclined surface opposite said base surface, said one of said hook and loop means being affixed to said base surface.

5. The stop assembly of claim 1 wherein said hook and loop means comprises a pair of pad-like elements having respectively thereon numerous hooks and loops.

6. The stop assembly of claim 1 wherein said pad-like element adapted to be affixed to such one of such relatively sliding members is of such a length as to permit adjustment of the position of said stop member thereon for adjusting the extent of permitted relative sliding movement between such relatively sliding members.

7. The stop assembly of claim 1 wherein a plurality of said pad-like elements are adapted to be secured in longitudinal spaced relation on such one of such relatively sliding member for selective engagement of said stop member to permit adjustment of the position of said stop member for adjusting the extent of permitted relative sliding movement between such relatively sliding members.

8. A security system for closures having a movable member movable between closed and open positions, said system comprising a wedge-shape stop member having a substantially planar base surface and an inclined top surface, means detachably to secure said stop member at its base surface at a location for engagement at said inclined surface with such movable member to restrict movement thereof in a direction parallel to said planar base surface, and storage means independently to secure said stop member at another location in the vicinity of such closure while permitting normal operation of such movable member with said stop member in such stored position.

9. The security system of claim 8 wherein said means detachably to secure includes a first pad-like element having numerous loops thereon, and means to secure one of said first and second pad-like elements to said stop member at said base surface and the other at such location.

10. A stop assembly for employment with closures including a movable member movable between closed and open positions, said stop assembly comprising a stop member and detachable hook and loop means adapted for mating engagement detachably to secure said stop member at a location for abutmemt with such movable member to restrict movement thereof and when separated for permitting unrestricted movement of such movable member.

11. The stop assembly of claim 10 wherein said stop member is wedge-shape.

12. The stop assembly of claim 11 wherein said hook and loop means comprise a pair of pad-like elements having respectively thereon numerous hooks and loops.

13. The stop assembly of claim 12 further comprising an additional pad-like element for stoage of said stop member.

* * * * *